343-756 SR
2/24/81 OR 4,253,100

United States Patent [19]
Commault et al.

[11] 4,253,100
[45] Feb. 24, 1981

[54] INVERSE CASSEGRAIN ANTENNA FOR MULTIPLE FUNCTION RADAR

[75] Inventors: Yves Commault; Francois Gautier; Robert Pierrot, all of Paris, France

[73] Assignee: Thomson-CSF, Paris, France

[21] Appl. No.: 116,661

[22] Filed: Jan. 29, 1980

[30] Foreign Application Priority Data

Feb. 2, 1979 [FR] France ..... 79 02768

[51] Int. Cl.[3] ..... H01Q 3/12; H01Q 19/19; B01Q 19/195

[52] U.S. Cl. ..... 343/756; 343/761; 343/781 CA

[58] Field of Search ..... 343/756, 761, 781 P, 343/781 CA, 837, 839, 914

[56] References Cited

U.S. PATENT DOCUMENTS 3,254,342 5/1966 Miller ..... 343/781 CA
3,771,160 11/1973 Laverick ..... 343/781 CA

*Primary Examiner*—Eli Lieberman
*Attorney, Agent, or Firm*—Cushman, Darby & Cushman

[57] ABSTRACT

Inverse Cassegrain antenna making it possible to use on the one hand the qualities of a conventional fine beam for look-out and tracking functions and making it possible on the other hand to have a widened beam either in the elevation plane or in the bearing plane. According to one embodiment, this antenna is provided with a mirror constituted by two reflector - polarizer elements joined to one another by a hinge which permits the articulation thereof, a remote control device regulating their relative orientation.

11 Claims, 10 Drawing Figures

INVERSE CASSEGRAIN ANTENNA FOR MULTIPLE FUNCTION RADAR

BACKGROUND OF THE INVENTION

The present invention relates to an inverse Cassegrain antenna for use in look-out or tracking and which is able to supply a widened beam either in the ground visualization elevation plane or in the bearing plane (anti-collision), whilst still retaining the qualities of a fine primary beam.

In a multiple function radar, it is desirable for the beam transmitted by the antenna to have, at a given moment, a shape adapted to the function for which it is to be used. On simple antennas, this has already been carried out by switching the primary sources or by modifying the shape of the antenna. However, this method of adapting an antenna to different functions of a radar does not give good results in the case of an inverse Cassegrain antenna. The performance of the Cassegrain antenna is reduced if the primary sources thereof are multiplied or if the parabolic deflector is deformed, making it necessary to modify the beam focusing device.

An advantageous way in which an inverse Cassegrain antenna with multiple functions can be realized is to modify the shape of the polarization rotation mirror with which it is equipped.

BRIEF SUMMARY OF THE INVENTION

The invention relates to an inverse Cassegrain antenna for a multiple function radar, comprising a primary source of high frequency electromagnetic waves with linear polarization, a curved primary reflector of revolution axis XX for reflecting the wave coming directly from the primary source and for selectively transmitting the electromagnetic wave having a crossed linear polarization, the primary source being essentially arranged in the focus of said primary reflector, a polarization rotation mirror ensuring the return to the primary reflector of the reflected radiation which has undergone a rotation of its polarization plane, wherein the polarization rotation mirror is formed by a plurality of reflector-polarizer elements, which are articulated with respect to one another and wherein said elements are associated with means for controlling their relative position.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
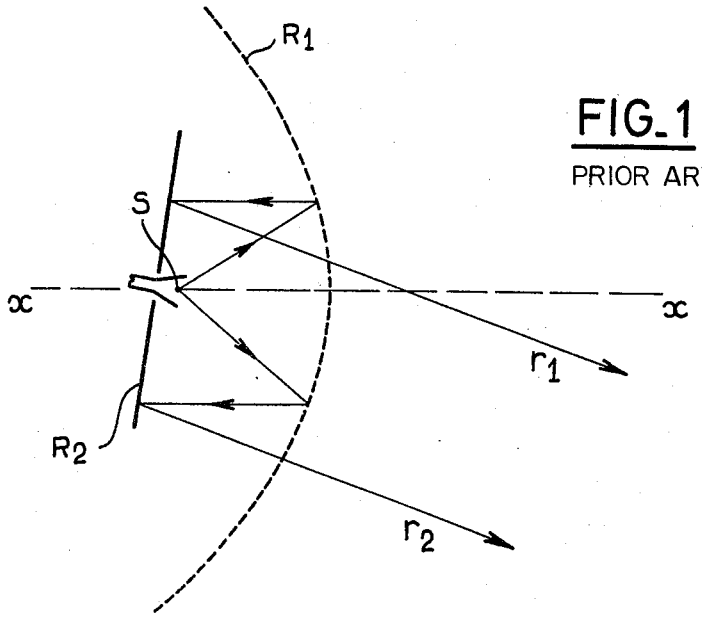
FIG 1 PRIOR ART
FIG. 1 an inverse Cassegrain antenna with a plane polarizer mirror of a conventional type.

A known inverse Cassegrain antenna comprises in the manner shown in FIG. 1 a primary source S for emitting high frequency electromagnetic waves, a parabolic primary reflector $R_1$ of revolution axis XX reflecting the radiation of primary source S and selectively transmitting the radiation having a crossed linear polarization, and an auxiliary polarization rotation plane reflector or mirror $R_2$, whereby this assembly forms a focusing system. The function of the primary source S on transmission is to illuminate the focusing system with a linear polarization electromagnetic wave (e.g. horizontal polarization), radiating a resolution diagram of amplitude, phase and polarization, which are clearly defined and stable in the frequency band used, and on reception to collect under optimum conditions the energy supplied by the echo and concentrated by the focusing system in the vicinity of its focus F in the form of a diffraction diagram.

In operation, the primary source s (FIG. 1) disposed in the focus F of parabolic reflector $R_1$ emits a linear (horizontal) polarization radiation, which is totally reflected by the parabolic reflector $R_1$, the angle formed by the incident beam and the reflected beam being equal to the angle of the incident beam and the axis XX of reflector $R_1$. The reflected rays, parallel to axis XX, are received by the auxiliary reflector $R_2$ (or mirror) and reflected, following a rotation of $\pi/2$ of their polarization plane (the horizontal polarization of the incident rays is transformed into vertical polarization), towards the parabolic reflector $R_1$ permitting the passage of the radiation having a vertical polarization plane, so that the beam from the antenna is then a substantially parallel beam.

Figure 2:
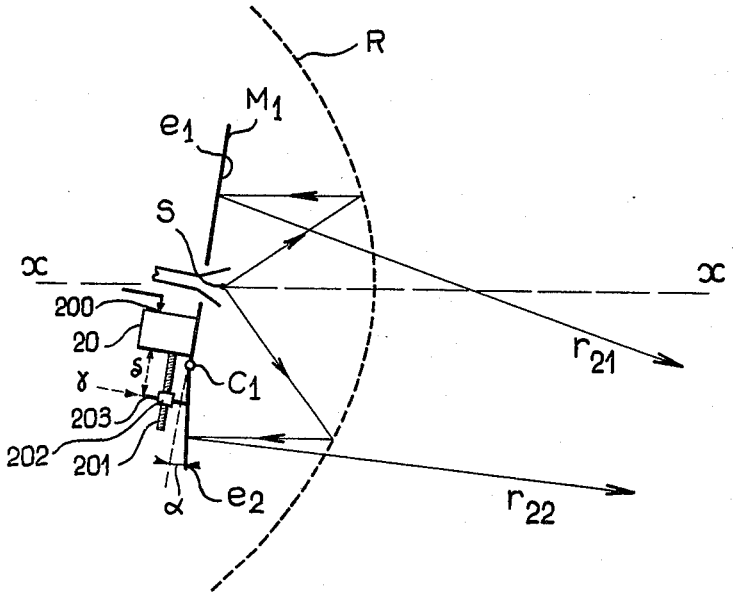
FIG. 2 an embodiment of an inverse Cassegrain antenna according to the invention.

According to an embodiment an inverse Cassegrain antenna according to the invention comprises, as shown in FIG. 2, a primary source S, a parabolic primary reflector R reflecting the primary radiation from source S and able to selectively transmit the radiation having a crossed linear polarization, said source S being located substantially in the focus F of the primary reflector R, a polarization rotation mirror $M_1$ formed by two plane reflector-polarizer elements $e_1$, $e_2$ joined by a hinge $c_1$ permitting their articulation.

Figure 7:
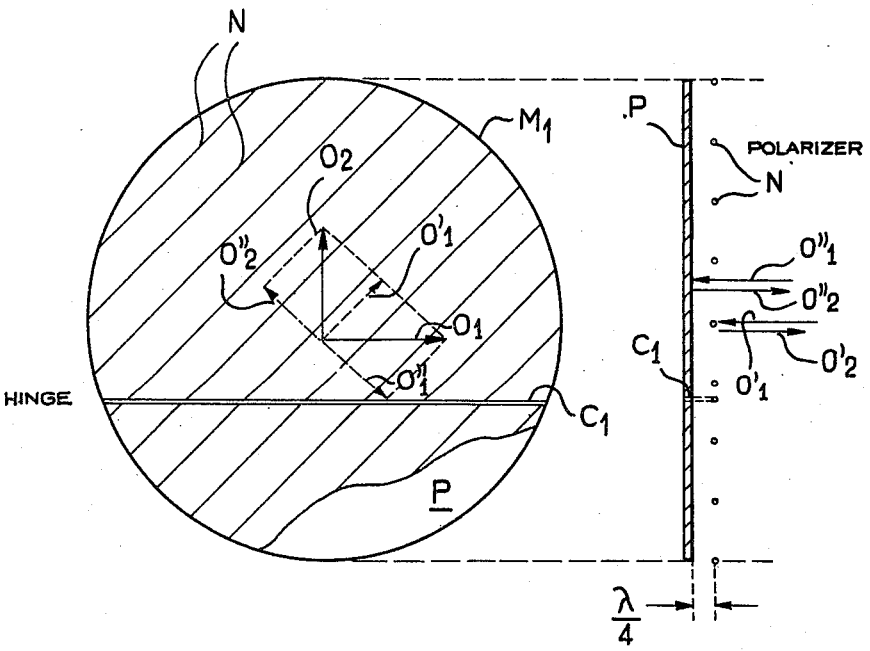
FIG. 7 a constructional detail of a polarization rotation mirror according to the invention.

These reflector-polarizer elements $e_1$, $e_2$ can in per se known manner (FIG. 7) comprise a metal plate P and a layer N of parallel wires inclined by 45° relative to the direction of the incident linear polarization, said layer N being arranged at k $\lambda/4$ from the plate P, k being an uneven integer and $\lambda$ the operating wavelength of the antenna. In operation, an incident wave $o_1$ with horizontal linear polarization can be considered as the superimposing of two equiphase component waves $o_1'$ and $o_1''$, whose polarization planes are inclined by 45° relative to the polarization plane of the incident wave $o_1$, the first component $o_1'$ being parallel to the wires of layer N and the second component $o_1''$ being perpendicular to said wires. Thus, the first component $o_1'$ is reflected by the wires, whilst the second component $o_1''$ traverses the layer N after having traversed a path equal to 2k $\lambda/4$, i.e. a path equal to k $\lambda/2$. At this moment, the second reflected component $o_2''$ is dephased by $\pi$ compared with the first reflected component $o_2'$ and the combination of the two components thus creates a wave $o_2$ with vertical polarization, which can traverse the parabolic reflector permitting the passage of vertical polarization radiation and reflecting horizontal polarization radiation. It is also possible to use systems of parallel metal plates which are also inclined by 45° relative to the incident polarization direction of the radiation for realizing the reflector-polarizer elements without passing beyond the scope of the present invention.

The construction of the parabolic reflector R is known per se. Reflector R can for example comprise a layer of horizontal wires when the linear polarization of the incident waves from primary source S is horizontal.

Figure 3:
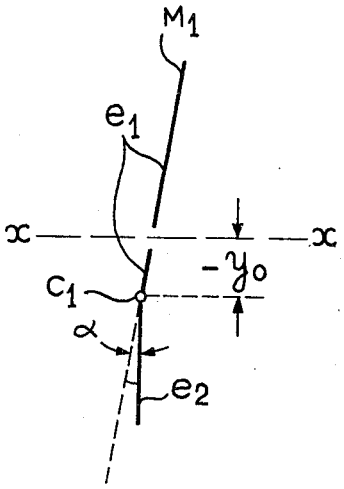
FIGS. 3 and 4 respectively a profile and front view of the mirror used in FIG. 2.
Figure 4:
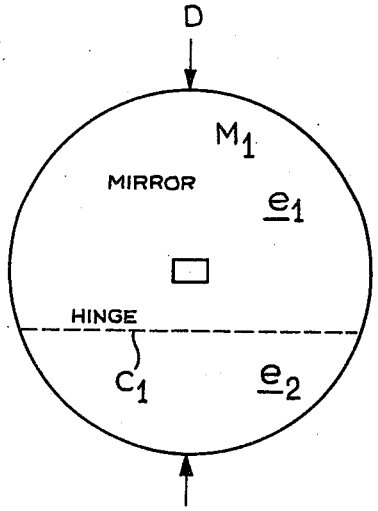
Figure 8:
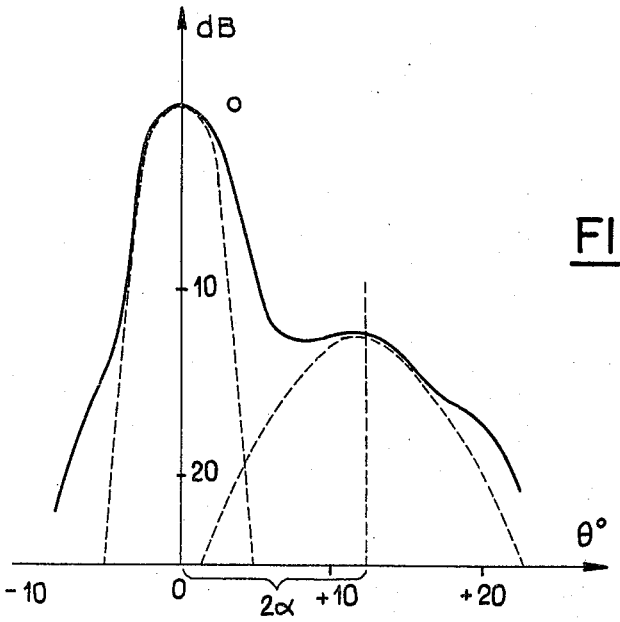
FIG. 8 characteristics of a wide beam obtained with an antenna according to the invention.

In an embodiment of the inverse Cassegrain antenna according to the invention, mirror $M_1$ comprises, in the manner shown in FIGS. 2 and 3, a hinge $c_1$ located at a third of its diameter D, said hinge $c_1$ being perpendicular to the vertical plane of symmetry of the antenna represented by the plane of the sheet in FIGS. 2 and 3. Element $e_2$, which is the smallest element, is inclined by an angle $\alpha$ of approximately 7° with respect to element $e_1$. Such a mirror $M_1$ permits an elevation coverage with a gain decrease which essentially obeys a square consecant law, such that the level at −17 dB is reached at 20° from the axis instead of the 5° obtained with a conventional fine beam (FIG. 8). The characteristics of the beam are also retained for any orientation of mirror $M_1$ and are only slightly selective in frequency.

Elements $e_1$ and $e_2$ of mirror $M_1$ can have relative inclinations in one or other direction. The movement of elements $e_1$, $e_2$ about hinge $c_1$ and their immobilization in a given position are obtained in the antenna according to the invention by means of a control device 20, which is actuated during the operation of the radar system.

The remote control device 20 is shown in the form of a non-limitative embodiment only in FIG. 2, in order not to overload the drawing and to provide a better understanding of the latter. Device 20 is, for example, constituted by a motor fixed to mirror $M_1$, whose spindle 201 comprises a worm screw having a sliding contact 202 driven by worm screw 201 in translation $\delta$ in accordance with the direction of mirror $M_1$ in the plane of FIG. 2. The sliding contact 202 has a pointer 203 which moves in a direction $\delta$ perpendicular to the translation direction $\gamma$ of the sliding contact and is driven in said direction by a gear system. The moving pointer 203 has one of its ends engaged in a slide positioned on the back of the reflecting surface of the reflector-polarizer element 22. For reasons of simplification, the slide is not shown in FIG. 2. Motor 20 is controlled by control signals at the level of a controlled input 200. Thus, a value $\Delta\delta$, $\Delta\delta$ representative of an angle $\alpha$ corresponds to each angular position of the driving shaft. In the equivalent control means for the reflector element $e_2$ does not pass beyond the scope of the present invention. Thus, mirror $M_1$ makes it possible to return to a parabolic reflector R (FIG. 2) rays having different reflection angles, depending on whether they strike elements $e_1$ or $e_2$. Thus, it can be imagined that there are two radiating pupils having slightly different complex amplitude distributions, which cooperate to form the desired beam in space. A simple calculation makes it possible to determine the phase law in the case of mirror $M_1$ with two elements $e_1$, $e_2$ (FIG. 3).

Thus, articulations $c_1$ introduce a linear phase law proportional to angle $\alpha$ formed between elements $e_1$ and $e_2$. $y_o$ is the distance of hinge $c_1$ from axis XX of the antenna and D the diameter of mirror $M_1$, the phase law can be written:

for:

$$D/2>y>-y_o|\phi=0 \text{ by convention}$$

and for:

$$-y_o>y>-D/2|\phi=(y-y_o)2\pi/\lambda \sin 2\alpha$$

D being the diameter of mirror $M_1$.

Figure 5:
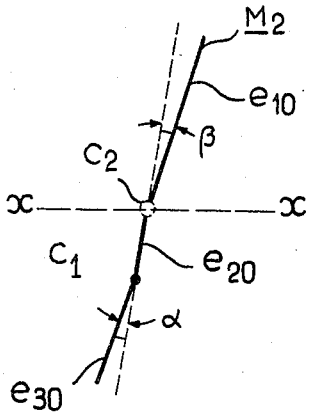
FIGS. 5 and 6 respectively profile and front views of another embodiment of a mirror used in an antenna according to the invention.
Figure 6:
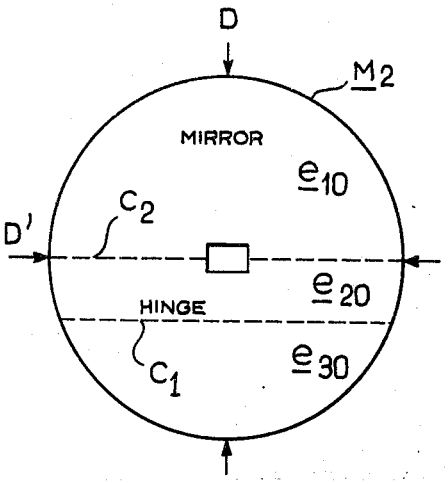

In another embodiment of the antenna according to the invention, the polarizer mirror is a mirror $M_2$ (FIGS. 5 and 6) formed by three plane reflector-polarizer elements $e_{10}$, $e_{20}$, $e_{30}$ articulated about two hinges $c_1$, $c_2$ which, according to FIGS. 5 and 6 are respectively disposed in accordance with a diameter D′ perpendicular to diameter D and to two thirds of diameter D. The two hinges $c_1$, $c_2$ are perpendicular to diameter D. Such a mirror $M_2$ makes it possible to operate the antenna according to the invention with a fine beam and monopulse channels (in this case elements $e_{10}$, $e_{20}$ and $e_{30}$ are coplanar) or with an asymmetrical beam for ground visualisation (in this case only elements $e_{10}$ and $e_{20}$ are coplanar, which corresponds to an articulation positioned at one third of the mirror $M_2$) or with a widened symmetrical beam, the inclination of reflector-polarizer elements $e_2$, $e_{30}$ bringing about a widening of the radiation diagram in the radiation plane of symmetry of the antenna and giving the possibility of using monopulse channels (mirror $M_2$ articulated only in the centre, $e_{20}$ and $e_{30}$ then being coplanar), whereby said widened beam can be used for a close look-out with rapid scanning.

Figure 9B:
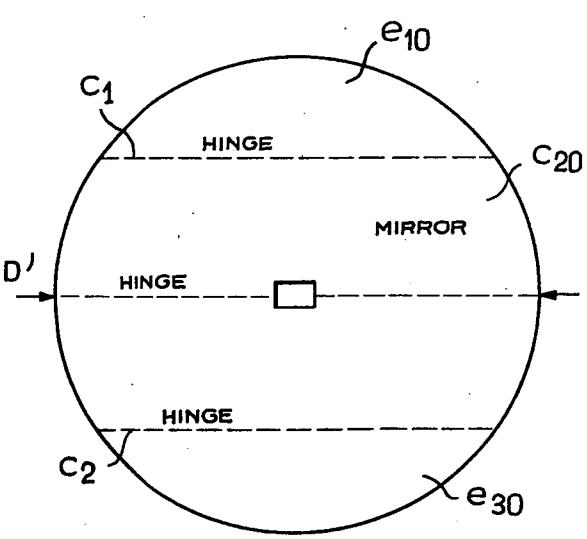
FIG. 9 diagrammatically at a and b a special way of realising a polarization rotation mirror according to the invention.
Figure 9A:
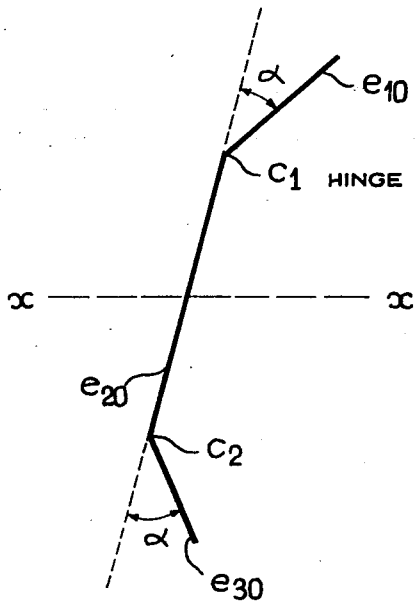

According to another non-limitative embodiment of the invention shown in FIGS. 9*a* and 9*b*, the polarizer mirror $M_2$ comprises three reflector-polarizer elements $e_{10}$, $e_{20}$, $e_{30}$ articulated to one another by two hinges $c_1$, $c_2$, which are symmetrical with respect to an antenna diameter perpendicular to diameter D. In the same way as hereinbefore, such a mirror makes it possible to obtain an operation of the antenna with a fine beam and "monopulse" channels, i.e. channels making it possible to obtain a deviation measurement signal of a target echo relative to axis XX of the antenna, or a wide beam and "monopulse" channels, when the reflector-polariser elements $e_{10}$, $e_{20}$, $e_{30}$ are respectively coplanar or symmetrically inclined by a same dihedral angle $\alpha$ relative to the plane of element $e_{20}$ and an operation with a widened asymmetrical beam, as shown in FIG. 8, when the reflector-polarizer elements are asymmetrically inclined.

In the vertical plane of symmetry of the antenna, FIG. 8 shows a radiation diagram as a function of a direction $\theta$ relative to axis XX. A maximum radiation relationship is obtained in direction $2\alpha$.

It should be noted thatin the case of "monopulse" channels in an antenna according to the invention, where the asymmetrical widened beam is obtained on the integrating channel, the differential channel formed in the vertical plane of symmetry of the antenna perpendicular to the hinges also becomes asymmetrical and therefore unusable. However, when a differential channel is formed in the plane parallel to the hinges and the symmetry in this plane is retained, the channel retains its properties in this plane, whilst benefiting in the other plane from a widening identical to that of the integrating channel.

It should also be noted that the characteristics of the beam emitted by the antenna according to the invention are retained, no matter what the orientation of the mirror assembly $M_1$ or $M_2$ and are only slightly selective in frequency.

It should finally be noted that the embodiments of the antenna according to the invention described and represented hereinbefore are not limitative. In particular, the mirror can comprise a plurality of articulated elements by using hinges arranged either perpendicularly to the vertical plane (as for mirrors $M_1$ and $M_2$) or parallel to said vertical plane.

What is claimed is:

1. An inverse Cassegrain antenna for a multiple function radar, comprising a primary source of high frequency electromagnetic waves with linear polarization, a curved primary reflector of revolution axis XX for reflecting the wave coming directly from the primary source and for selectively transmitting the electromagnetic wave having a crossed linear polarization, the primary source being essentially arranged in the focus of said primary reflector, a polarization rotation mirror ensuring the return to the primary reflector of the reflected radiation which has undergone a rotation of its polarization plane, wherein the polarization rotation mirror is formed by a plurality of reflector-polarizer elements, which are articulated with respect to one another and wherein said elements are associated with means for controlling their relative position.

2. An antenna according to claim 1, wherein the polarization rotation mirror is formed by two reflector-polarizer elements articulated about a hinge perpendicular to a diameter of the antenna.

3. An antenna according to claim 2, wherein the hinge is positioned at two thirds of said diameter.

4. An antenna according to claim 1, wherein the polarization rotation mirror is formed by three plane reflector-polarizer elements articulated about two hinges perpendicular to a diameter of the antenna.

5. An antenna according to claim 4, wherein the hinge is positioned in accordance with a diameter of the antenna, the other hinge being positioned at essentially two thirds of the said diameter.

6. An antenna according to claim 4, wherein the two hinges are arranged symmetrically with respect to a diameter of the antenna.

7. An antenna according to claim 1, wherein the hinges are perpendicular to the vertical plane of symmetry of the antenna.

8. An antenna according to claim 1, wherein the hinges form an angle differing from $(\pi/2)$ with the vertical plane of symmetry of the antenna.

9. An antenna according to claim 1, wherein the reflector-polarizer elements are constituted by a planar metal plate in front of which and at a distance equal to $k(\lambda/4)$ is arranged a planar layer comprising metal wires inclined by 45° relative to the instant radiation polarization direction, $\lambda$ being the operating wavelength of the antenna and k an uneven integer.

10. An antenna according to claim 1, wherein the reflector-polarizer elements are constituted by metal plates, which are also inclined by 45° relative to the incident radiation polarization direction.

11. An antenna according to claim 1, wherein the means controlling the relative positioning of the reflector-polarizer elements comprise a motor fixed to the mirror and whose spindle is constituted by a worm screw having a sliding contact driven in translation by said worm screw, the sliding contact having a pointer which moves in a direction perpendicular to the sliding contact translation direction, the moving pointer having one end engaged in a slide located on the back of the reflecting surface of the reflector-polarizer element.

* * * * *